US006528711B1

(12) United States Patent
Paige

(10) Patent No.: US 6,528,711 B1
(45) Date of Patent: Mar. 4, 2003

(54) CAPO

(76) Inventor: Bryan R. Paige, 4491 W. Sterling Rd., Jonesville, MI (US) 49250

( * ) Notice: Subject to any disclaimer, the term of this patent is extended or adjusted under 35 U.S.C. 154(b) by 0 days.

(21) Appl. No.: 09/972,338

(22) Filed: Oct. 5, 2001

(51) Int. Cl.[7] ..... G10D 3/00
(52) U.S. Cl. ..... 84/318; 84/320
(58) Field of Search ..... D17/20, 21; 84/320, 84/318, 319

(56) References Cited

U.S. PATENT DOCUMENTS

| | | | | | |
|---|---|---|---|---|---|
| 3,933,073 | A | | 1/1976 | Hutchins | |
| 4,048,894 | A | * | 9/1977 | Myerson et al. | 84/318 |
| 4,143,576 | A | | 3/1979 | Nichols et al. | |
| 4,250,790 | A | | 2/1981 | Shubb et al. | |
| 4,324,165 | A | | 4/1982 | Wilkerson | |
| 4,583,440 | A | * | 4/1986 | Powell, Jr. | 84/318 |
| 4,793,234 | A | | 12/1988 | Geis | |
| 5,016,514 | A | | 5/1991 | Kaufman | |
| 5,081,894 | A | | 1/1992 | Paige | |
| 5,101,706 | A | | 4/1992 | Kilgore | |
| 5,117,723 | A | | 6/1992 | Veenschoten | |
| D365,118 | S | | 12/1995 | Kyser | |
| 5,492,045 | A | | 2/1996 | Roblee | |
| 5,569,863 | A | | 10/1996 | Lem | |
| D378,936 | S | | 4/1997 | Dunlop | |
| 5,623,110 | A | | 4/1997 | Hoglund et al. | |
| 5,792,969 | A | | 8/1998 | Shubb et al. | |
| 6,008,441 | A | * | 12/1999 | Steinberger | 84/318 |
| 6,096,954 | A | | 8/2000 | Hatfield | |
| 6,410,832 | B1 | * | 6/2002 | Sterner | 84/318 |

FOREIGN PATENT DOCUMENTS

| | | |
|---|---|---|
| DE | 382448 | 10/1923 |

* cited by examiner

*Primary Examiner*—Kim Lockett
(74) *Attorney, Agent, or Firm*—Donald R. Fraser

(57) ABSTRACT

An improved capo for use with various stringed instruments, such as for example a guitar, for fastening over the fingerboard or fret board to shorten the strings uniformly and facilitate a change of key. The capo includes a pair of normally closed spring biased jaw members and integral lever members operative to open the jaw members for movement along the length of fret board for selectively retaining all of the strings in abutting relation to the fret board. The improved capo is formed of spring stock to facilitate the attachment and positioning of the capo along the fret board.

8 Claims, 2 Drawing Sheets

CAPO

BACKGROUND OF THE INVENTION

1. Field of the Invention

The present invention relates to a capo for a stringed musical instrument mountable at selective positions on the fret board to change the pitch of the strings without the necessity to retune the instrument.

2. Description of the Prior Art

Capos for changing the pitch of stringed musical instruments are well known in the prior art. The capos in the prior art function as clamps to change the pitch of a stringed musical instrument. While the prior art devices function satisfactorily to achieve the change of pitch of the instrument to which they are applied, there continues to be a need for a capo of simple design which can be economically produced and is readily capable of being operated by either the right hand or left hand of the of the musician and is of a size which will not interfere with the performance of the musician.

It is a primary object of the invention to produce a capo which may be readily moved to various positions on the fret board of a stringed musical instrument to change the pitch of the instrument.

Another object of the invention is to produce a capo for use on stringed musical instruments which can be moved from the position to another on the fret board of a stringed musical instrument by one hand of the musician.

Another object of the invention is to produce a copy for stringed musical instruments which may be readily and economically manufactured by using round, square, or rectangular shaped wire or bars.

SUMMARY OF THE INVENTION

The above objects of the invention may be typically achieved by a capo for a stringed musical instrument having a neck, an extended fret board mounted on a surface of the neck, and a plurality of strings extending in spaced parallel relation longitudinally in a plane generally parallel to and spaced from and along the length of the fret board comprising a length of spring wire, the wire having a first end portion for contact with the plurality of strings adjacent the surface of the neck of the musical instrument, a second end portion for contact with an opposing surface of the neck of the musical instrument, a coiled spring portion, a first handle connecting the first end portion to the spring portion, and a second handle connecting the second end portion to the coiled spring portion.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings in which.

DESCRIPTION OF THE PREFERRED EMBODIMENT

Figure 1:
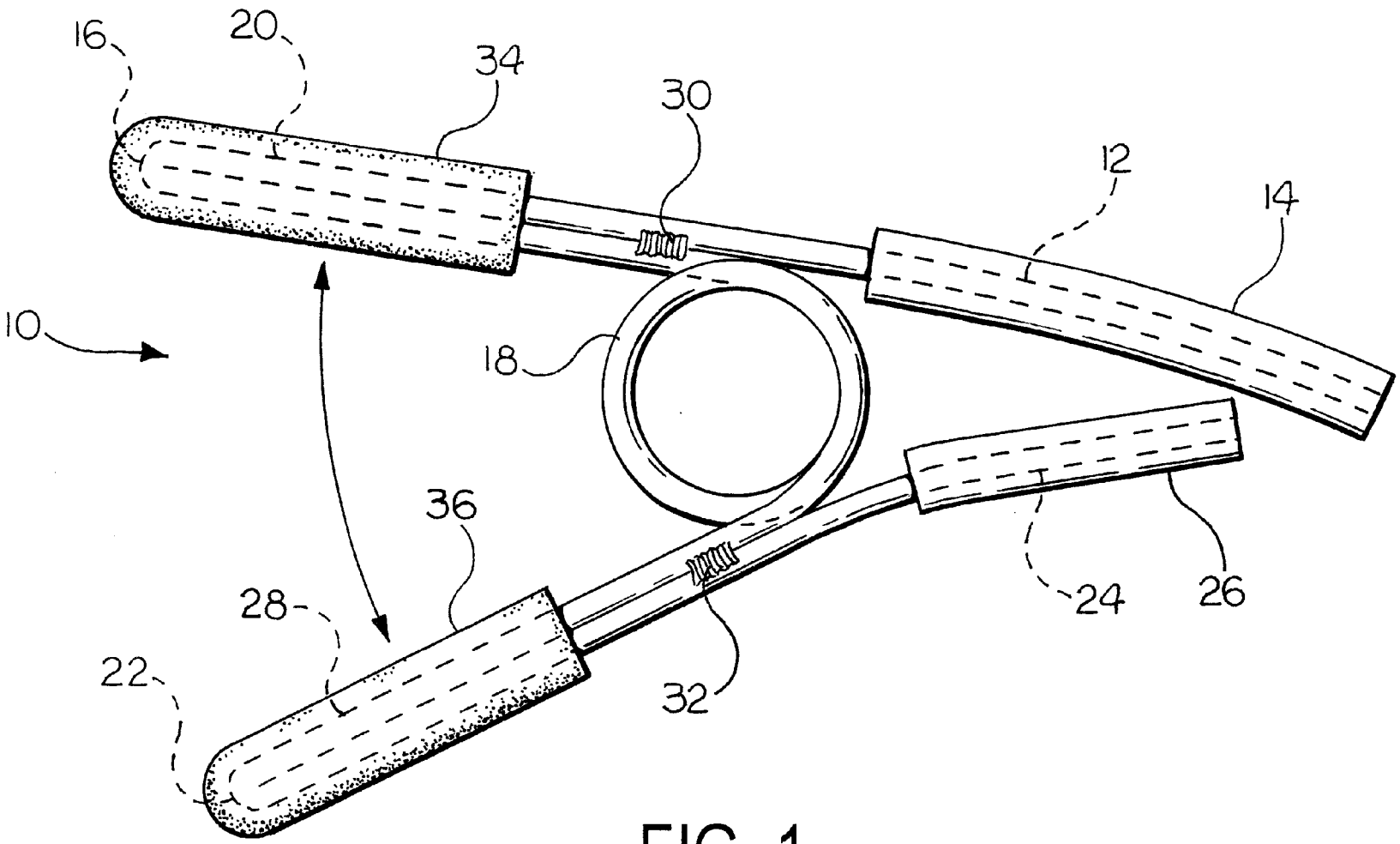
FIG. 1 is an elevational view of a capo embodying the features of the invention.

Referring to the drawings, there is illustrated a capo, generally indicated by reference manual 10, incorporating the features of the present invention. More specifically, the capo 10 is fabricated from a length of spring wire stock preferably of a circular cross-section. The length of spring wire stock includes a first end portion 12 provided with a cylindrical pad 14 of elastomeric material, such as for example polyurethane. The first end portion 12 is typically of a length sufficient to span across the strings of guitar as illustrated and described in connection with the written description of FIG. 2. It has been found that a length of two (2) inches was satisfactory.

The spring stock is caused to extend from the first end portion 12 along a line and is folded upon itself to form a fold 16 and then continues to a centrally disposed coiled spring 18. The spring wire stock folded upon itself forms a first lever arm 20.

The coiled spring 18, in the illustrated embodiment, is formed by winding the spring wire stock in a counter clockwise direction to form a single centrally disposed coil which continues along a line and is folded upon itself to form a fold 22 and then continues to a second end portion 24 provided with a cylindrical pad 26 of elastomeric material, such as for example polyurethane. The folded spring wire stock forms a second lever arm 28.

The portions of the spring wire stock which are folded upon themselves to form the folds 16 and 22, are typically welded together as at welds 30 and 32, respectively. The welds 30 and 32 are provided to supplement the integrity of the overall structure.

Cylindrical finger gripping pads 34 and 36 are individually placed over the first and second lever arms 20 and 28, respectively, of the device. The pads 34 and 36 may be formed of a foam material for example.

Normally, the capo 10 is in the rest position illustrated in FIG. 1.

Figure 2:
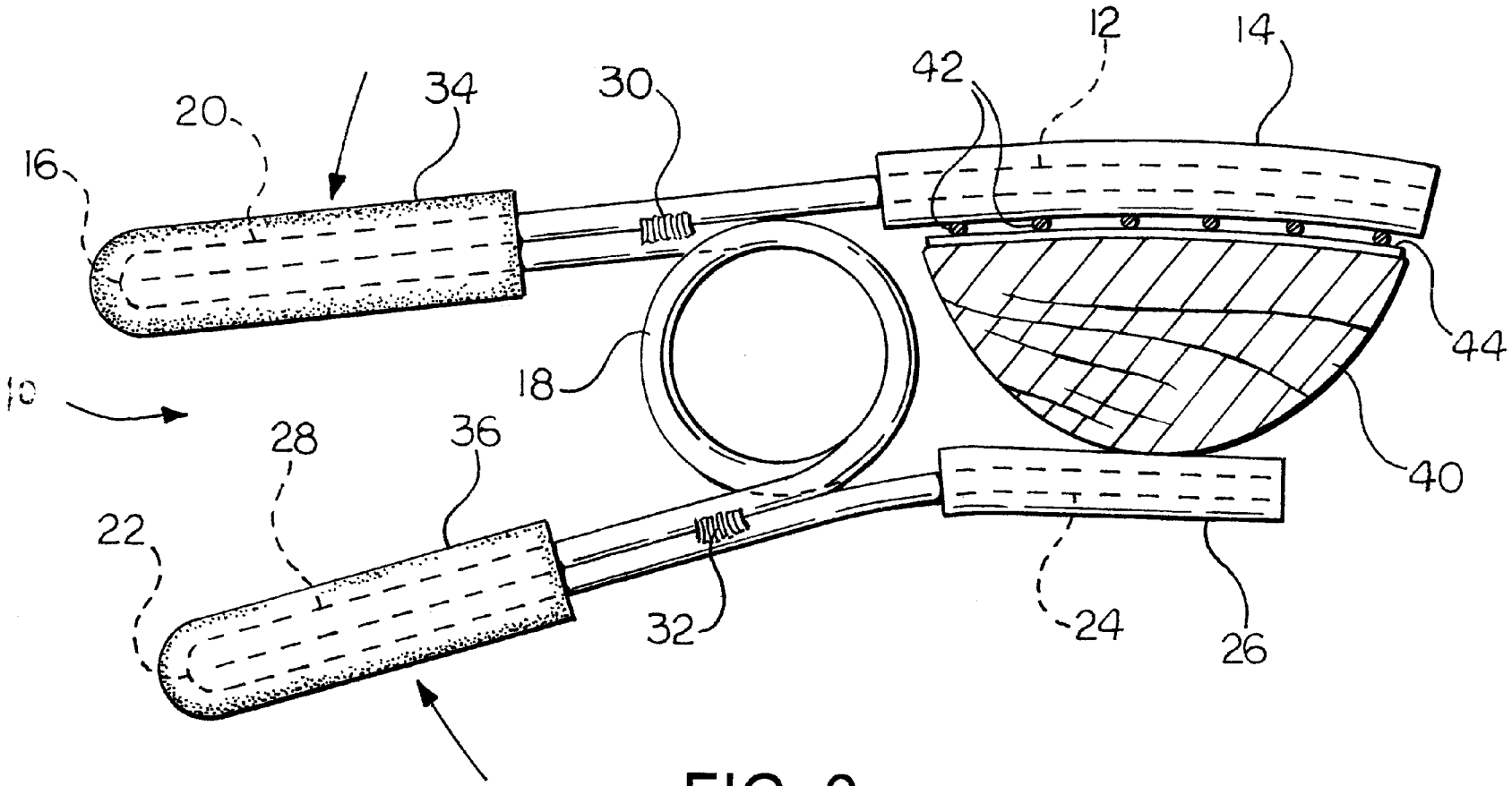
FIG. 2 is a view of the capo illustrated in FIG. 1 showing the device mounted to the fret board of a musical instrument.

In using the capo of the present invention, the musician grasps the first and second lever arms 20 and 28 of the device containing the pads 34 and 36, respectively, by either the right hand or the left hand. Typically, the pad 34 bears against the palm of the musician's hand, while the first three fingers of the musician's hand grasp the pad 36. The fingers are caused to apply pressure against the pad 36 and the first lever arm 20 to force the same to contract or move toward the second lever arm 28 causing the first end portion 12 and the second end portion 24 to move away from one another as illustrated in FIG. 2 to provide a greater gap therebetween. The entire capo 10 is then moved to receive the neck 40 of the guitar which is caused to move into the gap with the first end portion 12 and its associated pad 14 to be positioned above the strings 42 of the guitar. The manual pressure of the musician's hand or the first lever arm 20 and the second lever arm 28 is then released, allowing the coiled spring 18 to urge the first end portion 12 and the second end portion 24 into abutting relation with the opposite side of the neck 40. The strings 42 are simultaneously forced into engagement with the fret board 44 of the guitar. Due to the physical properties of the elastomeric pads 14 and 26 the entire capo 10 is prevented from sliding off the neck.

When it is desired to reposition the capo along the neck of the guitar, or to remove the capo from the neck, the lever arms 20 and 28 are grasped in the manner previously described to cause the first and second end portions 12 and 24 to move to a release position.

While mention has been made in the aforesaid description that the spring wire stock used in fabricating the capo embodying the features of the invention is of circular cross-section, it is understood that other cross-sectional shapes can likewise be satisfactorily employed.

The coiled spring 18 is illustrated and described as having only a single coil. It must be understood that the strength requirements of the spring in the invention will dictate the type of wire stock, the diameter and cross-sectional configuration of the wire stock, and the number of coils of the spring.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A capo for a stringed musical instrument having a neck, an extended fret board, and a plurality of strings extending in spaced parallel relation longitudinally in a plane generally parallel to and space from the fret board along the length of the fret board comprising:

a length of spring wire, said wire having a first end portion for contact with the plurality of strings adjacent the surface of the neck of the musical instrument, a second end portion for contact with an opposing surface of the neck of the musical instrument, a coiled spring portion, a first handle connecting the first end portion to the coiled spring portion, and a second handle connecting the second end portion to the coiled spring portion.

2. The apparatus defined in claim 1 including pads connected to the first and second end portions of said length of spring wire.

3. The apparatus defined in claim 2 wherein said pads are formed of an elastomeric material.

4. The apparatus defined in claim 3 wherein said pads are cylindrical.

5. The apparatus defined in claim 4 wherein said spring wire is circular in cross-section.

6. The apparatus defined in claim 1 wherein the first handle and the second handle of said spring wire are formed by said wire being bent upon itself.

7. The apparatus defined in claim 1 wherein the first end portion is formed to span and receive a plurality of strings of a musical instrument.

8. The apparatus defined in claim 1 wherein the second end portion is formed to receive the neck of a musical instrument.

* * * * *